US007055448B2

(12) United States Patent
Hadcroft et al.

(10) Patent No.: US 7,055,448 B2
(45) Date of Patent: Jun. 6, 2006

(54) METHOD FOR ACCOMMODATING LARGE MOVEMENTS IN A MOORING SYSTEM

(75) Inventors: John Mackay Hadcroft, Christchurch (NZ); Peter James Montgomery, Christchurch (NZ)

(73) Assignee: Mooring Systems Limited, Christchurch (NZ)

( * ) Notice: Subject to any disclaimer, the term of this patent is extended or adjusted under 35 U.S.C. 154(b) by 62 days.

(21) Appl. No.: 10/220,010

(22) PCT Filed: Feb. 26, 2001 (Under 37 CFR 1.47)

(86) PCT No.: PCT/NZ01/00025

§ 371 (c)(1), (2), (4) Date: Jan. 20, 2004

(87) PCT Pub. No.: WO01/62584

PCT Pub. Date: Aug. 30, 2001

(65) Prior Publication Data

US 2005/0087118 A1 Apr. 28, 2005

(30) Foreign Application Priority Data

Feb. 26, 2000 (NZ) ..... 501395

(51) Int. Cl.
*B63B 21/00* (2006.01)

(52) U.S. Cl. ..... 114/230.1

(58) Field of Classification Search ..... 114/230.1
See application file for complete search history.

(56) References Cited

U.S. PATENT DOCUMENTS

| | | | | |
|---|---|---|---|---|
| 3,227,481 | A | 1/1966 | Creskoff | |
| 3,322,091 | A | 5/1967 | Stanwick | |
| 3,463,114 | A | 8/1969 | Lovell | |
| 3,974,794 | A | 8/1976 | Kakitani et al. | |
| 4,055,137 | A | 10/1977 | Motai et al. | |
| 4,532,879 | A | 8/1985 | Ortloff | |
| 4,543,070 | A | 9/1985 | Olsen et al. | |
| 4,549,835 | A | 10/1985 | Ando et al. | |
| 4,852,926 | A | 8/1989 | Littell | |
| 5,676,085 | A | 10/1997 | Michl, Jr. | |
| 6,439,147 | B1 | 8/2002 | Cottrell et al. | |
| 6,910,435 | B1 * | 6/2005 | Hadcroft et al. | 114/230.15 |
| 2001/0029879 | A1 | 10/2001 | Cottrell et al. | |
| 2004/0154518 | A1 | 8/2004 | Hadcroft et al. | |

FOREIGN PATENT DOCUMENTS

| | | |
|---|---|---|
| DE | 25 57 964 | 12/1976 |
| DE | 92 07 648.3 | 10/1992 |

(Continued)

*Primary Examiner*—Stephen Avila
(74) *Attorney, Agent, or Firm*—Knobbe, Martens, Olson & Bear LLP

(57) ABSTRACT

A method of operating a mooring system exemplified by active mooring devices having attractive attachment elements fixable to a ship's hull. Each mooring device includes active means for moving the attachment element vertically and in the horizontal plane, and the method involves repositioning the attachment elements in a stepwise manner. The mooring devices also includes a seal for a vaccum attachment element.

16 Claims, 4 Drawing Sheets

S

FOREIGN PATENT DOCUMENTS

| | | |
|---|---|---|
| EP | 55044057 | 3/1980 |
| EP | 58206478 | 12/1983 |
| EP | 61218495 | 9/1986 |
| FR | 2 672 650 | 8/1992 |
| GB | 1 491 511 | 11/1977 |
| JP | 55-44057 | 3/1980 |
| JP | 58-206478 | 12/1983 |
| JP | 61-218495 | 9/1986 |
| JP | 07033075 A | 2/1995 |
| JP | 08034388 A | 2/1996 |
| NL | 8600973 | 4/1986 |
| WO | 91/14615 | 10/1991 |
| WO | 98/17868 | 4/1998 |
| WO | WO 01/62585 | 8/2001 |

* cited by examiner

METHOD FOR ACCOMMODATING LARGE MOVEMENTS IN A MOORING SYSTEM

RELATED APPLICATIONS

This application is a National Phase in the United States of PCT/NZ01/00025 and claims the benefit of the New Zealand Application 501394 filed Feb. 26, 2000.

TECHNICAL FIELD

The present invention relates to mooring devices for mooring vessels and, more particularly to a method and mooring system for accommodating large relative movements between two objects moored or secured together.

BACKGROUND ART

One disadvantage of traditional mooring is the necessity to constantly adjust the mooring lines, particularly when a ship is secured to a fixed dock. This adjustment is to account for movement of the ship in response to winds, shifting tides, the addition or removal of cargo, and the like. The combination of high tidal movements and variations in ship displacement due to loading can result in a considerable vertical movement having to be accommodated by the mooring system.

With a mooring device such as that described in the co-pending U.S. application Ser. No. 10/220,009 which is based upon New Zealand Patent application No. 501395 (which specification is incorporated herein by reference), a vacuum attachment cup assembly is fixed to the ship's hull. Mechanical means limits movement of mooring robot up and down over the full extent of the relative vertical travel. This possible movement necessitates a larger working area, with consequent complication and increased cost.

Japanese patent abstract publication no. 58206478 describes a mooring device and a method of changing the position of a vacuum cup fastening the device to the hull. When the device reaches the limits of its vertical travel the negative pressure in the vacuum cup is raised to a degree permitting the cup to slide without releasing from the hull. At its limits of travel this passive method therefore offers greatly reduced mooring forces, making the moored vessel vulnerable to failure of the mooring in adverse conditions of weather and current. The seal of the vacuum cup also suffers from abrasion when the cup slides down the hull in this manner and so to avoid regular sliding movement during operation the mooring device is provided with increased mechanical travel in the vertical direction, with consequent added complication and expense.

It is an object of the present invention to provide a mooring system and method of operating a mooring system for accommodating a large relative vertical movement of a ship when docked. It is a further objective of the present invention to provide a mooring system and method and system for accommodating a large relative vertical movement of a ship when docked which overcomes the problems of the prior art.

A still further object of the present invention is the provision of a seal for use in an attachment element for use on a mooring robot.

It is an object of the present invention to address the foregoing problems or at least to provide the public with a useful choice.

Further aspects and advantages of the present invention will become apparent from the ensuing description which is given by way of example only.

DISCLOSURE OF INVENTION

According to one aspect of the present invention there is provided a seal for a vacuum attachment element, which element can be secured against a surface, said seal comprising a circumferential seal member of substantially constant cross-section, said member being mountable in a support frame rigidly fixed to the attachment element, the seal member being of elastomeric material and including:

a first sealing face which has an arcuate portion between inner and outer edges, wherein partial deformation of the said first sealing face is required before the said inner sealing edge contacts the surface.

According to another aspect of the present invention there is provided a seal for an attachment element substantially as described above, wherein the attachment element is part of a mooring robot.

According to another aspect of the present invention there is provided a seal for an attachment element substantially as described above, wherein the mooring robot releasably fastens to the surface, being a surface of a first movement object, the mooring robot being mountable to a second object, said first object moving in response to the application of external forces, relative to the second object, which movement moves the first object from a pre-determined operating position, of the type as described in the co-pending U.S. patent application Ser. No. 10/220,009 which is based upon New Zealand Patent application No. 501395.

According to a still further aspect of the present invention there is provided a method of operating a mooring system, which system includes at least a first and second mooring robot, each mooring robot having a robot arm with at least one attachment element for releasable engagement with a surface, wherein the operating method involves stepwise movements to re-position the attachment elements between respective starting and a finishing positions in which positions all attachment elements are fastened to the surface, the method including the steps:

(a) with respect the first mooring robot, releasing all respective first attachment elements from engagement with the surface;

(b) moving all said first attachment elements, by operation of the first mooring robot, and re-fastening said elements in the respective finishing position on the surface;

(c) with respect to the second mooring robot, releasing all respective second attachment elements from engagement with the surface; and (d) moving all said second attachment elements, by operation of the second mooring robot, and re-fastening the said elements in the respective finishing position on the surface.

According to a still further aspect of the present invention there is provided a method of operating a mooring system, substantially as described above, including the steps:

(e) with respect to any further mooring robots releasing all respective attachment elements from engagement with the surface; and (f) moving all said respective attachment elements, by operation of the mooring robot, and re-fastening the said attachment elements in the respective finishing position on the surface.

According to a still further aspect of the present invention there is provided a method of operating a mooring system, substantially as described above, wherein the steps are performed sequentially.

According to a still further aspect of the present invention there is provided a method of operating a mooring system, substantially as described above, wherein the steps (a) and (c) and the steps (b) and (d) in respect of each mooring robot, are performed at the same time.

According to a still further aspect of the present invention there is provided a method of operating a mooring system, substantially as described above, wherein the mooring robots are mounted to a fixed or floating dock and the said surface is part of the freeboard of a ship's hull. Alternatively, the mooring robots may be mounted to a floating vessel for mooring to another vessel or a plate fixed to a fixed or floating dock.

According to a still further aspect of the present invention there is provided a method of operating a mooring system, substantially as described above, wherein each mooring robot includes means for at least two translational degrees of freedom for positioning each attachment element. Most preferably the mooring robot provides three-degrees of translational freedom for controlling of the position of each attachment element and each attachment element is pivotally fixed to the movement mechanism.

According to a still further aspect of the present invention there is provided a method of operating a mooring system, substantially as described above, wherein the stepwise movement is performed in the vertical direction, allowing the mooring system to accommodate large vertical movements between a ship and its dock. One or two of the mooring robots may be at or approaching the limits of vertical travel before the stepwise movement is initiated. Alternatively, the stepwise movement may be performed in the horizontal direction for providing movement of the ship in the fore-and-aft direction.

According to a still further aspect of the present invention there is provided a method of operating a mooring system, substantially as described above, wherein the method is performed with a mooring system which includes mooring robots as described in the co-pending U.S. application Ser. No. 10/220,009 which is based upon New Zealand Patent application No. 501395. Four mooring robots, in first and second pairs are employed, the first pair performing the stepwise movement while the second pair remains fastened to the ship. Alternatively both the first and second pairs may perform the stepwise movement together.

According to a still further aspect of the present invention there is provided a method of operating a mooring system, substantially as described above, wherein the attachment element is an array of vacuum cups, each vacuum cup having a seal as described according to the first aspect above.

It will be appreciated that one of the cups of the each mooring robot is sufficient to hold that portion of the ship moored, during the operation of the above described method. Thus very large vertical movements of a vessel can be accommodated, without the need to re-moor a vessel and without risking the security of the mooring system.

BRIEF DESCRIPTION OF DRAWINGS

Further aspects of the present invention will become apparent from the following description which is given by way of example only and with reference to the accompanying drawings in which.

BEST MODES FOR CARRYING OUT THE INVENTION

Figure 1:
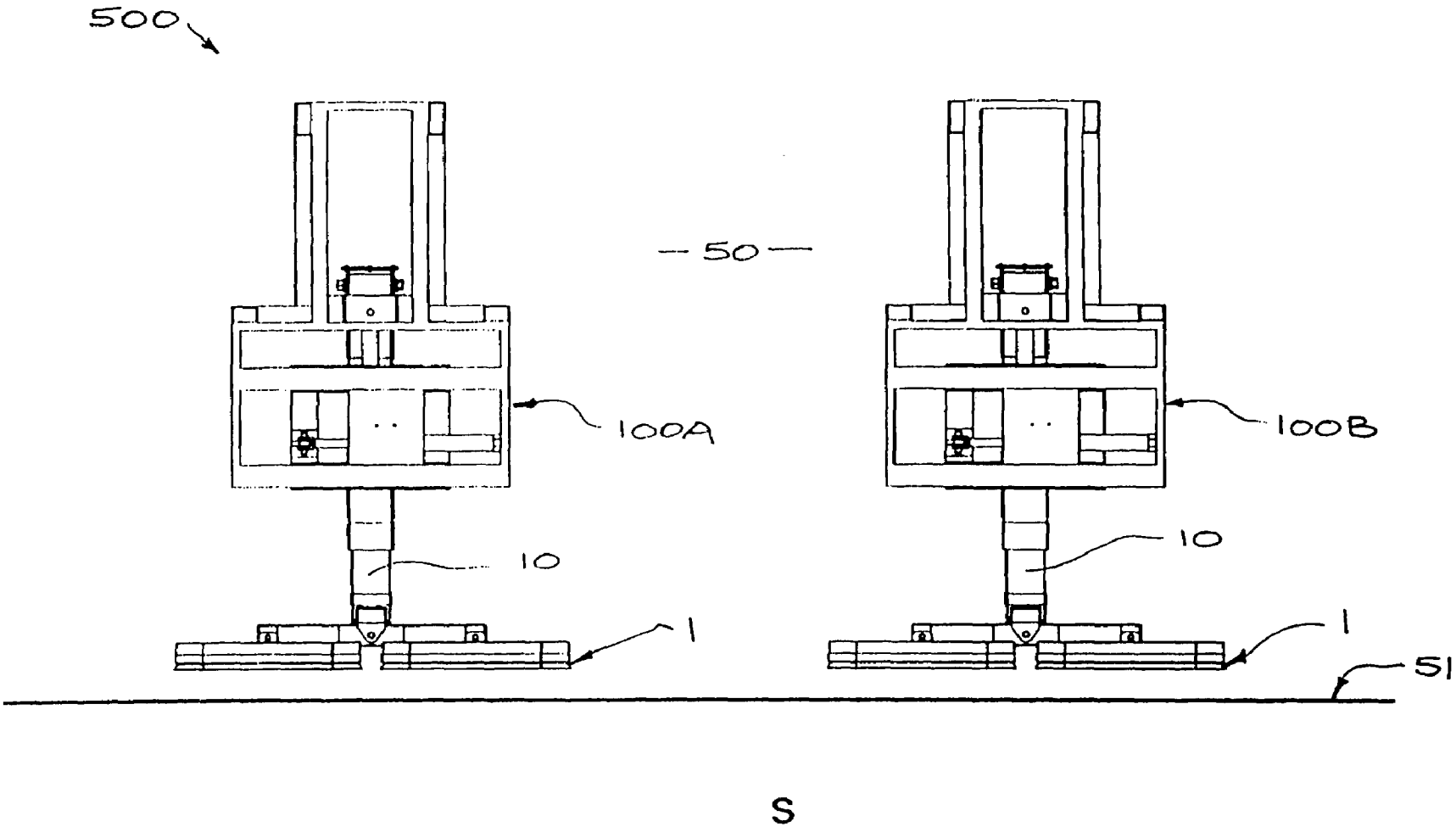
FIG. 1 is a plan view of a pair of mooring robots, being a first preferred arrangement for performing the stepwise movement method according to the present invention.

Referring to FIG. 1 of the drawings, a device for performing the method of the present invention comprises the first preferred embodiment of a mooring system 500, as described in the co-pending U.S. application Ser. No. 10/220,009 which is a national phase of PCT application PCT/NZ01/00026 which is based upon New Zealand Patent application No. 501395 is illustrated in plan view. The description of the mooring robot and mooring system in the co-pending application is hereby incorporated by reference.

Other preferred embodiments (not illustrated) include a mooring system 500 wherein mooring robots 100 are fixed to the ship S allowing the ship S to be readily fastened to a bearing plate fixed to the dock 50 or to another ship S. It will be appreciated, however, that this as well as other robot type mooring devices may be employed for performing the method of the present invention.

In the following description 100*a*, 100*b* have been used to refer to two specific examples of the mooring robot 100. FIG. 1 shows a first mooring robot 100*a* and a second mooring robot 100*b* fixed to the dock 50 for mooring a ship S. The mooring system 500 includes at least two pairs of mooring robots 100*a*, 100*b* at spaced positions along a mooring face of the dock 50. Each mooring robot 100 has two separate vacuum cups 1 pivotally fixed to a robot arm 10 and permitting accurate positional control of the vacuum cups 1 in three dimensions.

The method of operating the mooring system 500 providing a stepwise movement is described below with reference to FIG. 2. To accommodate a ship S falling or rising relative to the dock 50 (FIG. 1), the vacuum attachment cups 1 fixed to the hull are raised or lowered respectively. It will be appreciated, however, that the same stepwise movement method applies to other relative movement such as moving the vacuum attachment cups 1 from side-to-side in the longitudinal direction, so the following description should not be seen a limiting.

Figures 4, 5:
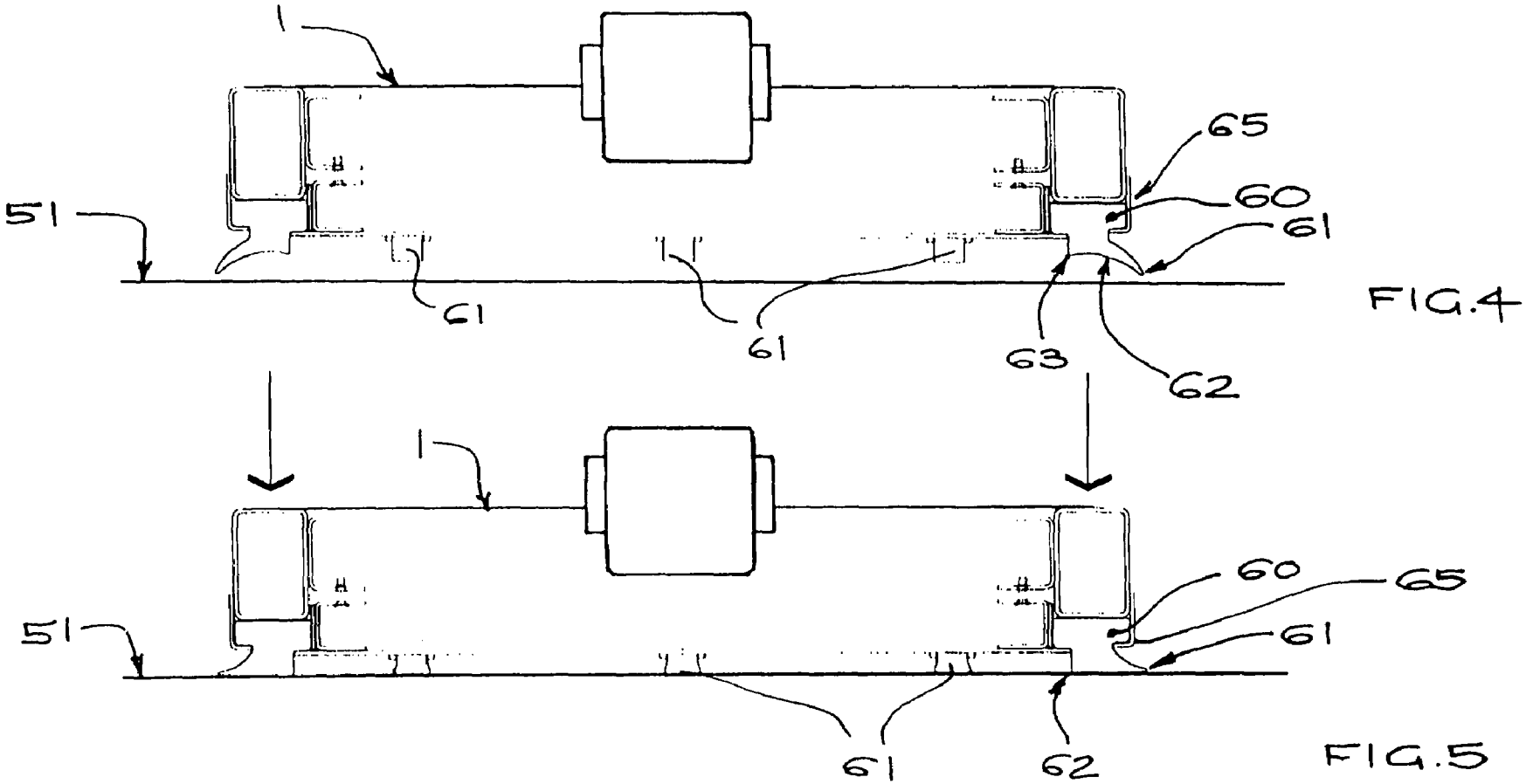
FIG. 4 is a sectional view of a vacuum cup provided with a seal according to the present invention in a released position.
FIG. 5 is a sectional view of a vacuum cup provided with a seal according to the present invention fully engaged with a hull surface.

Before mooring the ship S, each vacuum attachment cup 1 is initially free (FIGS 1 and 4). From initial engagement each cup 1 moves through partial engagement (not shown) to complete engagement (FIG. 5) wherein both the seal 60 and the abutment member 61 are fully compressed.

Figure 2:
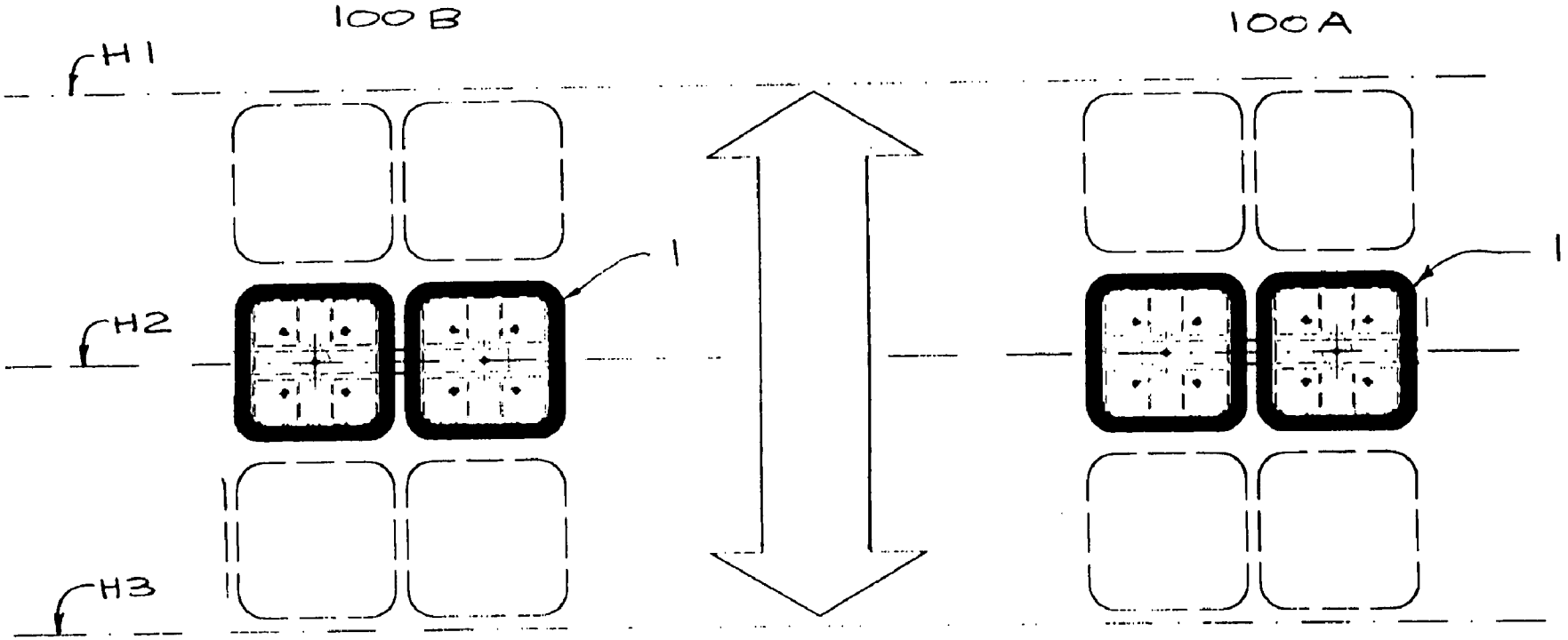
FIG. 2 is a front elevation illustrating the vertical travel of the vacuum cups of the mooring robots according to FIG. 1.
Figure 3:
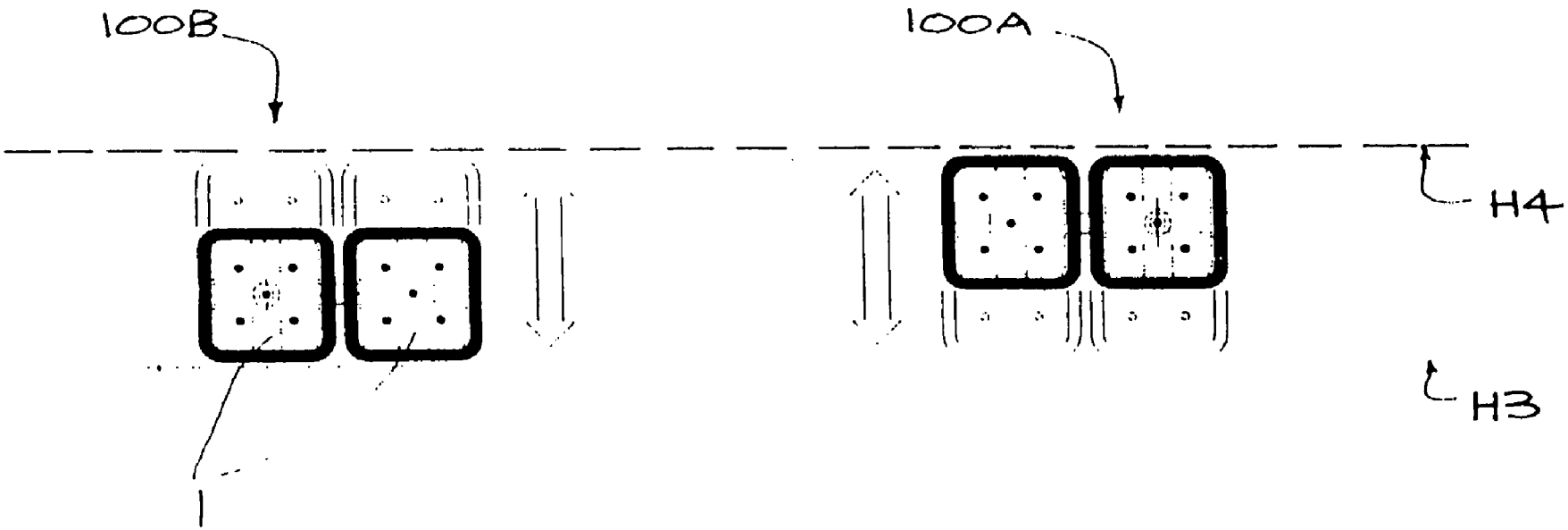
FIG. 3 is front elevation of the vacuum cups of FIG. 2 at an intermediate stage in the stepping movement of the present invention.

Referring to FIGS. 2 & 3, the vacuum attachment cups 1 of both mooring robots (100*a*, 100*b*) are fixed to the hull at approximately the same height H2 and the mooring robots (100*a*, 100*b*) are able to accommodate a limited degree of vertical travel either side of height H2, between an upper limit of travel at height H1 and a lower limit of travel at H3. The heights H1, H2, H3 are absolute heights relative to the fixed dock 50.

When the controls (not shown) of the mooring system 500 detects a requirement to raise the mooring robots 100, due to a mooring robot (100*a*, 100*b*) approaching the limit of its downward travel H3 (through either a falling tide or the addition of cargo) the stepwise movement of the vacuum attachment cups 1 is then initiated.

FIG. 3 shows an intermediate stage during the process of raising the vacuum cups 1 from height H3 to height H4. The vacuum cups 1 of the first mooring robot 100*a* have been released and the vacuum cups 1 raised to height H4. Before moving the vacuum attachment cups 1 they are completely released from engagement with the hull (to a position as shown in FIG. 4) thereby allowing the movement to be completed more quickly, as is desired.

Next the vacuum cups 1 of the first mooring robot 100*a* are fully engaged (FIG. 5). On indication of complete engagement, the second mooring robot 100*b* is also raised to height H4 in the same manner.

A first preferred embodiment of a seal 60 according to the present invention is shown in FIG. 4

According to a still further aspect of the present invention there is provided a method of operating a mooring system, substantially as described above, wherein the steps are performed sequentially.

According to a still further aspect of the present invention there is provided a method of operating a mooring system, substantially as described above, wherein the steps (a) and (c) and the steps (b) and (d) in respect of each mooring robot, are performed at the same time.

According to a still further aspect of the present invention there is provided a method of operating a mooring system, substantially as described above, wherein the mooring robots are mounted to a fixed or floating dock and the said surface is part of the freeboard of a ship's hull. Alternatively, the mooring robots may be mounted to a floating vessel for mooring to another vessel or a plate fixed to a fixed or floating dock.

According to a still further aspect of the present invention there is provided a method of operating a mooring system, substantially as described above, wherein each mooring robot includes means for at least two translational degrees of freedom for positioning each attachment element. Most preferably the mooring robot provides three-degrees of translational freedom for controlling of the position of each attachment element and each attachment element is pivotally fixed to the movement mechanism.

According to a still further aspect of the present invention there is provided a method of operating a mooring system, substantially as described above, wherein the stepwise movement is performed in the vertical direction, allowing the mooring system to accommodate large vertical movements between a ship and its dock. One or two of the mooring robots may be at or approaching the and FIG. 5. The seal 60 provides a continuous seal around the circumference of each vacuum cup 1, to which it is rigidly fixed. The seal 60 is made from elastomeric material, preferably neoprene. It includes a first arcuate sealing face 62 between an inner sealing edge 63 and an outer sealing edge 61.

The seal 60 is optionally used to form the perimeter of each vacuum cup 1 used in the method of the present invention. However, it will be appreciated by those skilled in the art that other seals may also be used without departing from the scope of the inventive method.

This configuration of the seal 60 allows it to absorb irregularities in the surface to which cup 1 is attached. During engagement of the seal 60, an initial seal is attained with partial deformation of the outer sealing edge 61 at the partial engagement stage (nor shown) before the inner sealing edge 61 contacts the hull of the ship S. With this seal 60 there has been found to be a predictable relationship between the amount of deformation at the partial engagement stage and the vacuum applied to the vacuum cups 1.

In the partial engagement stage the arcuate face 62 is readily adapted for sliding engagement with the hull of a ship S or another surface.

The above method of operating a mooring system has been described with reference to vessel moored to a dock, which may be either fixed or floating. However, it will be appreciated that the dock may be replaced by a vessel (so that there is vessel to vessel docking and relative movement). Also, it will be appreciated that the mooring system, described herein as affixed to the dock, may be fixed to the vessel. The operation is the same except that the surface is a surface affixed to the dock.

Also, the above method of operating a mooring system has been described with reference to vessel moored to a dock. It will, however, be appreciated that another type of vessel or object may be moved relative to a second object, for example under water, etc without departing from the scope of the invention.

Aspects of the present invention have been described by way of example only and it should be appreciated that modifications and additions may be made thereto without departing from the scope thereof.

The invention claimed is:

1. A method of operating a mooring system, the mooring system comprising at least a first and a second mooring robot, each mooring robot having a robot arm with an attachment element for releasably fastening to a surface, the first and second robots each having first and second attachment elements respectively, wherein the operating method incorporates co-ordinated stepwise movements to re-position each attachment element between respective spaced apart starting and finishing positions, in which positions the attachment elements are fastened to the surface, the method comprising the steps:

(a) firstly, while maintaining the second attachment element in its respective starting position, releasing the first attachment element from the surface;

(b) secondly, while maintaining the second attachment element in its respective starting position, actuating the first mooring robot to move the first attachment element and re-fasten the first attachment element in its respective finishing position;

(c) thirdly, while maintaining the first attachment element in its respective finishing position, releasing the second attachment element from the surface; and (d) fourthly, while maintaining the first attachment element in its respective finishing position, actuating the second mooring robot to move the second attachment element and re-fasten the second attachment element in its respective finishing position.

2. The method of claim 1, wherein the mooring robots are mounted to a fixed dock.

3. The method of claim 1, wherein the mooring robots are mounted to a floating dock.

4. The method of claim 1, wherein said surface is part of a freeboard of a ship's hull.

5. The method of claim 1, wherein the mooring robots are mounted to a floating vessel.

6. The method of claim 1, wherein each mooring robot provides means for at least two-dimensional movement for positioning the attachment element.

7. The method of claim 1, wherein each attractive element is pivotally fixed to a mooring robot providing three-dimensional translational movement, the mooring robot allowing external forces to displace the moored object, and the attachment element engaged therewith, by a distance in the horizontal plane from a selected moored position; wherein, separate from its structural components, the mooring robot comprises resilient restorative means which provide a restorative force acting to restore the attachment element to the selected moored position.

8. The method of claim 7, wherein the three dimensional translational movement comprises movement of the mooring robot about two substantially perpendicular axes of rotation and translational movement along a translational axis arranged substantially perpendicular to the plane of the two axes of rotation.

9. The method of claim 7, wherein each attractive element is pivotally fixed to a mooring robot providing three-dimensional translational movement, the mooring robot allowing external forces to displace the moored object, and the attachment element engaged therewith, by a distance in the horizontal plank from a selected moored position; wherein, separate from its structural components, the mooring robot comprises resilient restorative means which provide a restorative force acting to restore the attachment element to the selected moored position.

10. The method of claim 1, wherein the stepwise movement is performed in the vertical direction.

11. The method of claim 1, wherein the stepwise movement is performed in the horizontal direction.

12. The method of claim 1, wherein in addition to the first and second mooring robots at least two additional mooring robots are employed, the attachment element of each additional mooring robot remaining fastened to the surface throughout the stepwise movement of the first and second robots.

13. The method of claim 9, wherein in addition to the first and second mooring robots at least two additional mooring robots are employed, the attachment element of each additional mooring robot remaining fastened to the surface throughout the stepwise movement of the first and second robots.

14. The method of claim 1, wherein each attachment element comprises an array of vacuum cups, each vacuum cup having a circumferential seal including a circumferential seal member of substantially constant cross-section, said member being mountable in a support frame rigidly fixed to the attachment element, the seal member being of elastomeric material and comprising:

a first sealing face which has an arcuate portion between first and second sealing edges wherein partial deformation of the said first sealing face adjacent the first edge is required before the said second sealing edge contacts the surface.

15. The method of claim 7 wherein each attachment element comprises an array of vacuum cups, each vacuum cup having a circumferential seal including a circumferential seal member of substantially constant cross-section, said member being mountable in a support frame rigidly fixed to the attachment element, the seal member being of elastomeric material and comprising:

a first sealing face which has an arcuate portion between inner and outer edges wherein partial deformation of the said first sealing face is required before the said inner sealing edge contacts the surface.

16. The method of claim 13 wherein each attachment element comprises an array of vacuum cups, each vacuum cup having a circumferential seal a circumferential seal member of substantially constant cross-section, said member being mountable in a support frame rigidly fixed to the attachment element, the seal member being of elastomeric material and comprising:

a first sealing face which has an arcuate portion between inner and outer edges wherein partial deformation of the said first sealing face is required before the said inner sealing edge contacts the surface.

* * * * *

UNITED STATES PATENT AND TRADEMARK OFFICE

CERTIFICATE OF CORRECTION

PATENT NO. : 7,055,448 B2
APPLICATION NO. : 10/220010
DATED : June 6, 2006
INVENTOR(S) : Hadcroft et al.

It is certified that error appears in the above-identified patent and that said Letters Patent is hereby corrected as shown below:

TITLE PAGE

Section (30), Foreign Priority Data, delete "501395" and enter --501394--.

COLUMN 2

Line 21 delete "movement" and insert -- moveable --.

COLUMN 5

Line 17 delete text beginning with "According to a still further aspect …" through line 50 before "and FIG. 5."

Signed and Sealed this

Nineteenth Day of December, 2006

JON W. DUDAS
*Director of the United States Patent and Trademark Office*